United States Patent [19]

File et al.

[11] 4,385,409

[45] May 31, 1983

[54] SHOWER CURTAIN BENDER

[76] Inventors: Robert H. File, P.O. Box 3006, Albuquerque, N. Mex. 87190; Karen S. File, 995 Paulson Ct., Lafayette, Calif. 94549

[21] Appl. No.: 262,792

[22] Filed: May 11, 1981

[51] Int. Cl.[3] ..... A47K 3/22

[52] U.S. Cl. ..... 4/608; 4/558; 4/610; 4/609; 160/330

[58] Field of Search ..... 4/608, 609, 610, 605, 4/607, 557, 558; 160/330, 349 R

[56] References Cited

U.S. PATENT DOCUMENTS

| | | | |
|---|---|---|---|
| 2,474,552 | 6/1949 | Steinmeyer | 160/349 X |
| 2,771,945 | 11/1956 | Withrup | 160/124 |
| 2,878,487 | 3/1959 | Foote | 4/610 |
| 2,923,013 | 2/1960 | Wasserman | 4/610 |
| 3,001,578 | 9/1961 | Ratliff | 160/349 X |
| 3,785,005 | 1/1974 | Baker | 160/124 |
| 3,807,482 | 4/1974 | Baker | 160/330 |

FOREIGN PATENT DOCUMENTS

| | | | |
|---|---|---|---|
| 1506373 | 9/1966 | France | 160/330 |

*Primary Examiner*—Charles E. Phillips

*Attorney, Agent, or Firm*—Harvey B. Jacobson

[57] ABSTRACT

A shower curtain bender for holding an end portion of a hanging shower curtain in close proximity to a vertical wall placed on one end of the shower enclosure to prevent shower water spray from splashing outside the enclosure from between the hanging shower curtain and the enclosure end walls comprises a pair of pivotal arms containing a series of slots superimposed on the last few attachment holes of the curtain to receive the hanger hooks, one of said arms bends the attached curtain into the shower enclosure and in close proximity to the vertically disposed enclosure end wall. A wedge positioned at the pivot between the two arms enables the curtain to be placed adjacent the compartment end wall without drooping. Additional pivot points enable the shower curtain to be folded neatly to one side or the other of the shower enclosure.

7 Claims, 4 Drawing Figures

SHOWER CURTAIN BENDER

BACKGROUND OF THE INVENTION

1. Field of the Invention

This invention relates to shower enclosures, and more particularly, to shower enclosures incorporating a tub and utilizing a shower curtain drawn across the open side of the shower enclosure. Usually, water escapes from the space between the edges of the shower curtain and the end walls of the shower enclosure since it is difficult to hold the ends of the curtain close to the enclosure walls, even though the shower curtain has its lower marginal portion wholly within the bathtub portion of the shower enclosure. Water escapes due to the ring support of the curtains at the top and also to billowing movement of the lower marginal portion of the shower curtain because of the rising heated air. Specifically, this invention relates to a shower curtain holder which is drawn across the open side of the shower enclosure and is able to manipulate the shower curtain to prevent the escape of water from the enclosure and which besides being a nuisance can pose a considerable safety hazard.

2. Description of the Prior Art

Various structures have heretofore been designed for the purpose of providing a more efficient barrier to water flowing or being splashed from the shower enclosure from the space between the edges of the drawn shower curtain and the end walls of the shower enclosure. Such attempts have primarily included permanent structures affixed to the end walls of the shower enclosure or the upper rim of the bathtub. For example, U.S. Pat. No. 4,007,072, issued Mar. 7, 1978, provides a device for preventing water escape from a shower compartment by releasably securing at least one end of the shower curtain to the bath tub compartment wall by utilizing interlocking fiber tab means (VELCRO) having one part secured to the curtain and a second part fixedly secured to the wall of the compartment. U.S. Pat. No. 3,934,636, issued Jan. 27, 1976, describes a shower curtain holder comprising a body portion adapted to be secured to the wall adjacent to the front outer corner of the bath tub and employing a friction slide therein arranged to project from the bottom and clamp the shower curtain down on the flange of the bathtub. U.S. Pat. No. 3,895,399, issued July 22, 1975, utilizes an upstanding flange provided for support from a shower enclosure in which the lower portion of the flange includes a slot to snugly receive the edge portion of a curtain drawn across the opening of the shower enclosure. U.S. Pat. No. 3,879,806, issued Apr. 29, 1975, discloses a shower curtain edge retainer for holding a marginal edge portion of the hanging shower curtain in contiguity with a bath cove wall in which the device includes a wall attachment bar which is vertically affixed to the bath cove wall and a connecting bar detachably supported by the wall attachment bar, the marginal edge of the shower curtain being detachably splined to the connecting bar which, when connected with the wall attachment bar, holds the curtain edge in line contact with the adjacent bath cove wall. U.S. Pat. No. 3,639,919, issued Feb. 8, 1972, also discloses a holder for a pair of bathroom shower curtains comprising a pair of flexible seal strips permanently adhered to a bathroom wall and extending downwardly from adjacent the shower curtain rod, each strip being provided with a keyhole slot extending for its entire length into which is pressed a cord which forms the outer edge of each curtain. U.S. Pat. No. 2,923,013, issued Feb. 2, 1960, prevents water from splashing around the side edge of a shower curtain by providing a shower bar attachment which allows a portion of the curtain to be drawn laterally of the bar and allows the side edge of the curtain to engage the wall along a line approximately six to eight inches inwardly from the open side of the tub.

While these prior art shower curtain holding devices have been somewhat successful in preventing the escape of water from the shower enclosure, the devices are permanent structures which are visible in and around the bath or shower enclosure. Such structures may not lend themselves to the interior design of the bathroom.

U.S. Pat. No. 2,878,487, issued Mar. 24, 1959, to Foote, discloses an anti-billowing shower curtain adapter which hooks onto the curtain rod and is placed against the inside surface of the curtain and includes a pivotal frame which can be pivoted inward into the shower enclosure and support the edge portion of the curtain therein so as to place an edge margin of the curtain in close proximity to the end wall of the shower enclosure. This patent also states that the weight of the end portion of the shower curtain acts on the inwardly supporting structure causing it to swing downwardly and in turn causes the frame of the device to swing outwardly against the portion of the curtain drawn across the shower enclosure opening. While this patent is not a permanent structure which affects the interior design of the bath area, the unsightly droop which is inherent in the device may be unacceptable to some persons. More importantly, the shower curtain adapter of Foote does not allow the curtain to be folded nearly flat against the shower enclosure wall when the shower is not in use. Further, the shower curtain adapter of Foote cannot be adjusted for use with curtains having different distances between the last and next to last hole used for supporting the shower curtain on the curtain rod, the distance variance being common among manufacturers.

SUMMARY OF THE INVENTION

According to the present invention and forming a primary object thereof, a shower curtain bender is provided which is effective to hold the curtain close to the end wall of the shower enclosure and at the same time is convenient in its use and economical to manufacture.

Another object of the invention is to provide a shower curtain bender of the type described which does not need to be permanently attached to structures in the shower enclosure area and is not visible when in use, thereby not affecting the interior design of the shower enclosure area.

Still another object of the invention is to provide a shower curtain holder which is effective to hold the curtain close to the front wall of the shower thereby preventing the escape of water from the shower enclosure area and which allows the curtain to be folded neatly adjacent the shower enclosure walls when not in use.

Briefly, the shower curtain bender of the present invention comprises a primary arm juxtaposed to the inside surface of the shower curtain along the top marginal edge thereof and held in place by the spaced hooks which hang the shower curtain on the rod, the hooks passing through holes in the primary arm superimposed on the second and third from last holes from the end of the shower curtain. A secondary arm pivotal from the primary arm is also juxtaposed to the inner surface of the shower curtain along the top marginal edge thereof and is secured thereto by a holding means securing the shower curtain at the last curtain hook hole thereof to the secondary arm. By pivoting the secondary arm into the shower enclosure, the end portion of the curtain can be held in close proximity to the end wall of the shower enclosure. At the pivot point between the primary and secondary arms, a wedge is provided to bias the secondary arm upwardly as it is bent inward into the shower enclosure so that as the weight of the end section of curtain pulls on the secondary arm, the secondary arm is lowered into a horizontal position, thus forcing the primary arm to move slightly upward on the shower curtain hooks which hold the curtain and primary arm to the curtain rod. The primary arm is further provided with a plurality of hinges so as to allow the curtain to be folded neatly against an end wall of the shower enclosure when not in use. A further feature of the shower curtain bender of the present invention includes a plurality of holes in the secondary arm to accommodate manufacturing variances in the distances between the last and next to last curtain hook holes along the top marginal edge of the shower curtain.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
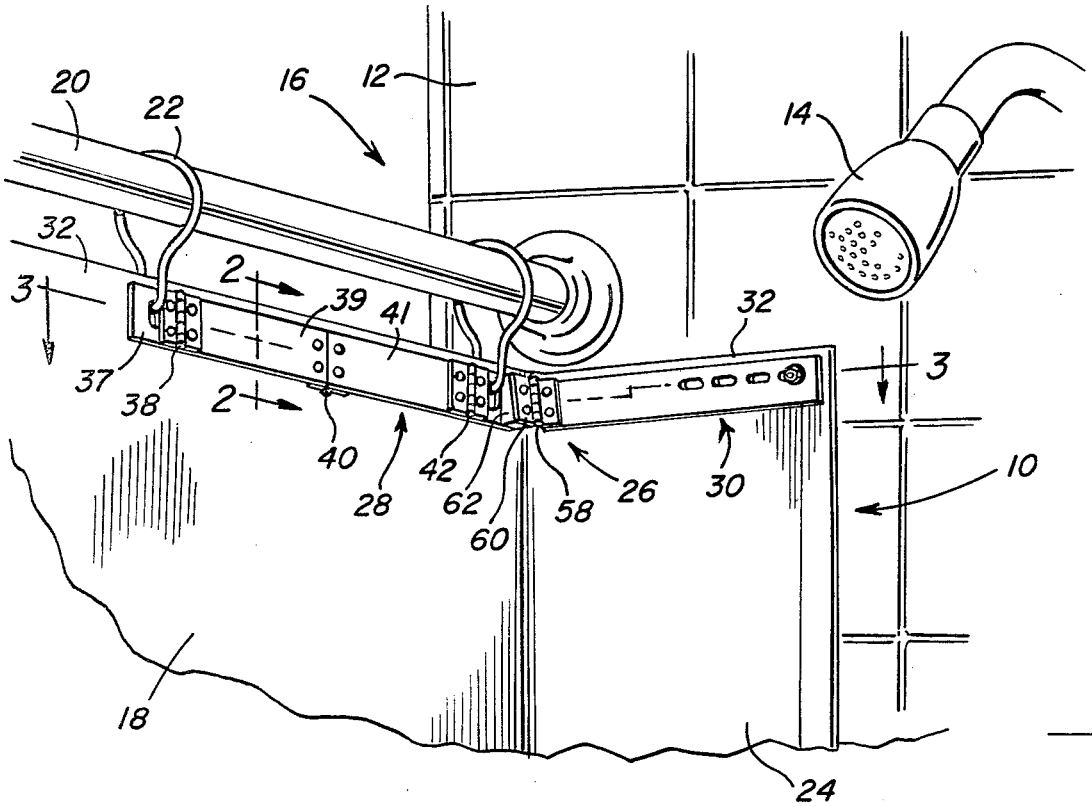
FIG. 1 is a perspective view illustrating the use of the shower curtain bender of the present invention for holding an end section of the curtain adjacent the end wall of the shower enclosure, the view being taken from within the shower enclosure.

Referring to FIG. 1, reference numeral 10 designates the shower enclosure area which includes an end wall 12 from which extends shower head 14. Placed across the open side 16 of a shower enclosure 10 is shower curtain 18 supported slidably on curtain rod 20 by means of a plurality of curtain hooks 22. A typical shower enclosure 10 comprises a bathtub extending between a pair of spaced end walls which also support the ends of a curtain rod placed above the bathtub for supporting the shower curtain to be drawn across an opening to close the shower enclosure from the remaining area of the room.

The present invention provides a device which holds an end portion 24 of shower curtain 18 closely adjacent end wall 12 of shower enclosure 10, thus preventing the escape of water from the enclosure. The shower curtain bender of the present invention is generally indicated by reference numeral 26 and includes a primary arm 28 and a secondary arm 30 pivotally attached to primary arm 28 so as to bend end portion 24 of shower curtain 18 into shower enclosure 10 and adjacent end wall 12.

Figure 3:
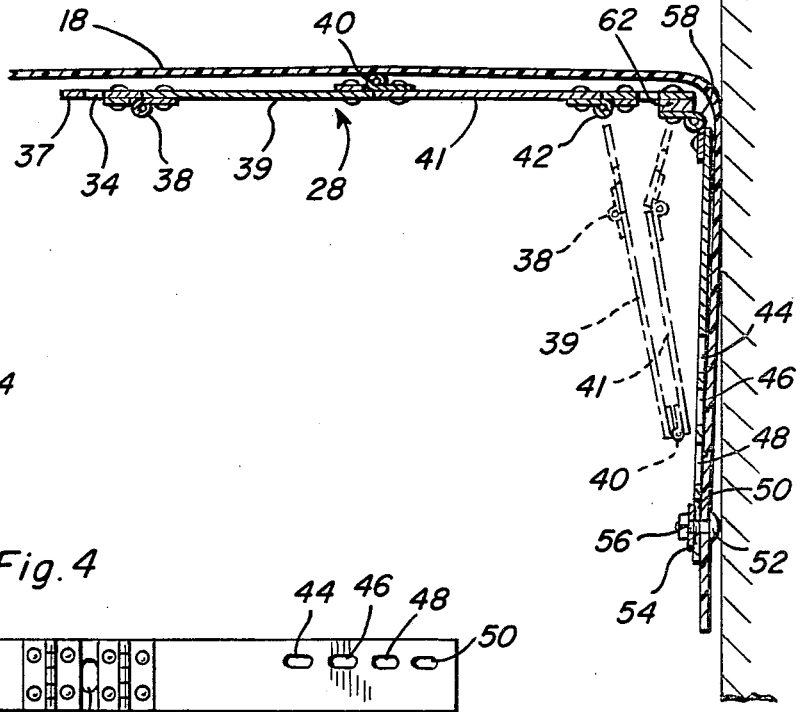
FIG. 3 is a sectional view illustrating the total shower curtain bender of the present invention and taken generally along the line 3—3 of FIG. 1.
Figure 4:
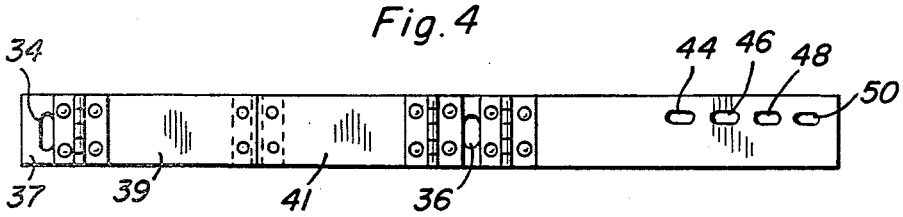
FIG. 4 is an elevational view illustrating the shower curtain bender in the fully elongated position.

Referring to FIGS. 1, 3 and 4, it can be seen that shower curtain bender 26 is supported along the upper marginal edge 32 of shower curtain 18. Primary arm 28 includes slots 34 and 36 which are superimposed on the third from last curtain hook and next to last holes, respectively, placed in top marginal edge 32 of shower curtain 18 to receive the plurality of shower curtain hooks 22. Accordingly, shower curtain hooks 22 pass through slots or openings 34 and 36 and the respective holes in shower curtain 18 to hold shower curtain bender 26 juxtaposed to the inside surface of shower curtain 18. Spaced along the length of primary arm 28 are a plurality of standard roll hinges 38, 40 and 42 pivotally connecting arm sections 37, 39 and 41 in a manner so as to provide alternative directional movement of the arm sections to allow shower curtain 18 to be folded neatly against end wall 12 when the shower is not in use as can be seen by the dotted line illustration in FIG. 3. Placed along one end of secondary arm 30 are a series of spaced slots or openings 44, 46, 48 and 50, one of which will be superimposed on the last shower curtain hook receiving hole of shower curtain 18', depending upon the distance of the last hole from the next to last curtain hook receiving hole. End portion 24 of shower curtain 18 is held to secondary arm 30 by a conventional bolt 52 which passes through the last hole of the shower curtain and secures curtain 18 to secondary arm 30 by attached washer 54 and nut 56. Of course, other attaching means may be utilized. Secondary arm 30 is pivotally mounted to primary arm 28 by standard roll hinge 58. Accordingly, when the shower is to be used, secondary arm 30 is simply pivoted into shower enclosure 10 thus holding attached end portion 24 adjacent to end wall 12.

Figure 2:
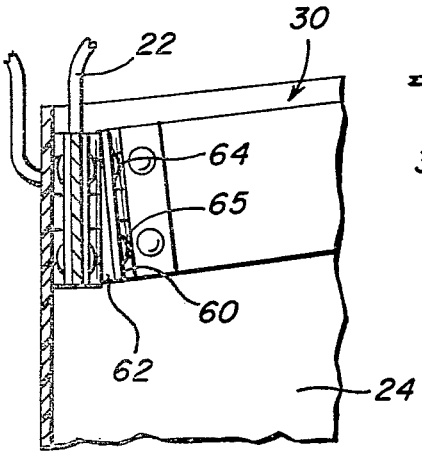
FIG. 2 is a fragmented sectional view of the shower curtain bender justaposed to the inside surface of the shower curtain and taken generally along the line 2—2 of FIG. 1.

Referring now to FIGS. 1 and 2, one of the unique features of shower curtain bender 26 is illustrated. Flange 60 of standard roll hinge 58 is secured to a wedge 62 by screws 64 and 65 which also hold wedge 62 onto primary arm 28. Wedge 62 causes standard roll hinge 58 to be supported at a slight angle upward from the horizontal. Accordingly, as secondary arm 30 is bent into shower enclosure 10, it is biased upwardly due to the orientation of hinge 58 supported on wedge 62. As the weight of end portion 24 of shower curtain 18 pulls downwardly on secondary arm 30 by gravity, arm 30 is lowered into a horizontal position by forcing primary arm 28 to move slightly upward on shower curtain hooks 22 which are placed through slots 34 and 36 of shower curtain bender 26. In this manner, shower curtain 18 when supported on shower curtain bender 26 does not droop or sag.

Shower curtain bender 26 may be placed on either or both ends of shower curtain 18 to assure that no water flows or is splashed out of shower enclosure 10. Shower curtain bender 26 can be formed of a series of rectangular metal brackets and metal roll hinges as illustrated in the figures, or can be formed of any other sturdy material which will enable secondary arm 30 to support end portion 24 of shower curtain 18. Furthermore, other pivoting means can be used in place of the standard roll hinges illustrated.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a curtain rod extending between and supported from the end walls of a shower enclosure having an outer open side extending between said end walls, a plurality of shower curtain hooks slidably mounted on said rod for guided movement therealong and supporting the upper marginal edge portion of a curtain therefrom at points spaced along said curtain from one end of the upper marginal edge portion thereof, a shower curtain support and deflector for supporting said one end adjacent to one of said end walls, said support and deflector including a primary arm, said primary arm having a plurality of longitudinally spaced openings formed therein each loosely receiving a shower curtain hook therethrough also passing through a corresponding opening formed in the upper marginal portion of said shower curtain, a secondary arm pivotally mounted to said primary arm, the end portion of said secondary arm remote from said primary arm including attachment means mounting said one end of said upper marginal portion of said curtain to said secondary arm, means mounted on said shower curtain support and deflector to bias said secondary arm upwardly, said biasing means comprising a wedge positioned on said primary arm, said wedge supporting the means to pivot said secondary arm with respect to said primary arm.

2. The shower curtain bender of claim 1 wherein said primary arm is formed from a plurality of arm sections, each arm section being pivotally connected to an adjacent arm section.

3. The shower curtain bender of claim 2 wherein said arm sections are pivotally connected by means of hinges, the hinges being arranged so that the arm sections will alternate in the direction in which they are pivotable.

4. A shower curtain bender for holding a shower curtain and holding an end portion of said curtain adjacent an end wall of a shower enclosure comprising; a horizontal primary arm for juxtaposing against the inside surface of a shower curtain and having inner and outer sides, a horizontal secondary arm having one end pivotally connected to one end of said primary arm for angular displacement relative thereto about an axis inclined upwardly and outwardly relative to said primary arm, said secondary arm including means to mount said secondary arm to a corresponding end of a shower curtain, said primary arm including a plurality of horizontally transverse openings formed therethrough for support of said primary arm from shoulder hooks slidably supported from a shower curtain rod and from which a shower curtain also is supported.

5. In combination with a curtain rod extending between and supported from the end walls of a shower enclosure having an outer open side extending between said end walls, a plurality of shower curtain hooks slidably mounted on said rod and a shower curtain including an upper marginal portion having openings formed therethrough at points spaced longitudinally therealong and through which said hooks are received, a shower curtain support and deflector for supporting one end portion of said curtain adjacent one of said end walls, said curtain support and deflector including a horizontal primary arm for juxtaposition against the inside surface of said shower curtain adjacent one end thereof and including inner and outer sides, a horizontal secondary arm having one end pivoted to the end of said primary arm adjacent said one end wall for angular displacement relative thereto about an axis inclined upwardly and outwardly relative to said primary arm, said primary arm having a plurality of horizontal transverse openings formed therethrough at points spaced longitudinally therealong and through which the shower curtain hooks are loosely received, the other free end of said secondary arm including attachment means supporting said one end of said curtain therefrom.

6. The combination of claim 5 wherein said primary arm is formed from a plurality of arm sections, each arm section being pivotally connected to an adjacent arm section.

7. The combination of claim 6 wherein said arm sections are pivotally connected by hinge means, the hinge means being arranged to enable the arm sections to swing in alternate directions.

* * * * *